US008245422B2

(12) United States Patent
Krikorian et al.

(10) Patent No.: US 8,245,422 B2
(45) Date of Patent: Aug. 21, 2012

(54) ATHLETIC SHOE CLEAT WITH DYNAMIC TRACTION AND METHOD OF MAKING AND USING SAME

(75) Inventors: Rand J. Krikorian, Brentwood, TN (US); John Robert Burt, Chandler, AZ (US)

(73) Assignee: Softspikes, LLC, Brentwood, TN (US)

( * ) Notice: Subject to any disclaimer, the term of this patent is extended or adjusted under 35 U.S.C. 154(b) by 621 days.

(21) Appl. No.: 12/399,183

(22) Filed: Mar. 6, 2009

(65) Prior Publication Data

US 2009/0223088 A1 Sep. 10, 2009

Related U.S. Application Data

(60) Provisional application No. 61/034,204, filed on Mar. 6, 2008.

(51) Int. Cl.
*A43B 5/00* (2006.01)
*A43C 15/16* (2006.01)
*A43C 15/05* (2006.01)

(52) U.S. Cl. ..... 36/134; 36/67 D; 36/127

(58) Field of Classification Search ..... 36/134, 36/67 D, 67 A, 67 R, 67 B, 59 A, 127, 128; D2/962
See application file for complete search history.

(56) References Cited

U.S. PATENT DOCUMENTS 4,014,114 A * 3/1977 Jordan et al. ..... 36/67 D
5,974,700 A 11/1999 Kelly
6,052,923 A 4/2000 McMullin
6,209,230 B1 4/2001 Curley, Jr.
D449,431 S * 10/2001 Savoie ..... D2/962
6,305,104 B1 10/2001 McMullin
6,327,797 B1 * 12/2001 Deacon et al. ..... 36/127
6,451,242 B2 * 9/2002 Kelly ..... 264/516
D469,246 S * 1/2003 McMullin ..... D2/962
6,675,505 B2 * 1/2004 Terashima ..... 36/134
6,823,613 B2 11/2004 Kelly et al.
6,834,445 B2 12/2004 McMullin
7,040,043 B2 5/2006 McMullin
7,073,280 B2 7/2006 Terashima
7,107,708 B2 9/2006 Kelly et al.
7,726,047 B1 * 6/2010 MacNeill et al. ..... 36/134
2003/0131502 A1 7/2003 Terashima
2004/0255489 A1 12/2004 Kelly et al.
2006/0059723 A1 3/2006 Robinson, Jr. et al.
2007/0277399 A1 12/2007 Dow et al.
2008/0072460 A1 3/2008 Robinson et al.

OTHER PUBLICATIONS

International Search Report and Written Opinion dated Oct. 7, 2010 received in PCT/US09/36282.

* cited by examiner

*Primary Examiner* — Jila M Mohandesi
(74) *Attorney, Agent, or Firm* — Edell, Shapiro & Finnan, LLC

(57) ABSTRACT

A single component traction cleat of co-molded hub and dynamic traction portions includes dynamic traction elements flexible about proximal ends secured inboard of and below a hub periphery having cut-outs through which the elements move when flexed. The hub has a cross-like configuration with spoke-like legs from which static traction elements depend. Locking posts located on the hub spoke legs include a recess between two symmetrical interference sections for receiving a locking tooth on a mating receptacle.

31 Claims, 12 Drawing Sheets

ATHLETIC SHOE CLEAT WITH DYNAMIC TRACTION AND METHOD OF MAKING AND USING SAME

CROSS REFERENCE TO RELATED APPLICATION

This application claims priority from U.S. Provisional Patent Application Ser. No. 61/034,204 entitled "Improved Athletic Shoe Cleat With Dynamic Traction," filed Mar. 6, 2008. The disclosure of this provisional patent application is incorporated herein by reference in its entirety.

BACKGROUND OF THE INVENTION

1. Technical Field

The present invention pertains to athletic shoes, particularly golf shoes, and to improved traction cleats removably connected to the outsole of such shoes. The invention further pertains to improved methods of fabricating the cleats, installing the cleats on shoe outsoles, and the operation of the cleats to provide traction.

2. Discussion of the Prior Art

It is also known in the prior art to provide a locking mechanism associated with the connection of the cleat to the shoe mounted connector to prevent inadvertent loosening of the connection and removal of the cleat. Examples of such locking mechanisms are found in U.S. Pat. Nos. 5,974,700 (Kelly), 6,823,613 (Kelly et al), and 7,107,708 (Kelly et al), and the disclosures from these patents (hereinafter referred to as the "Kelly patents" are also incorporated herein by reference in their entireties. Among these locking mechanisms is one sold under the trademark FAST TWIST® comprising radially facing locking formations on the cleat and receptacle, respectively, operative to inter-engage when the stem has been screwed into the socket or connector of the shoe-mounted receptacle. One of the locking formations, typically on the receptacle connector, comprises an annular array of radially projecting locking teeth, while the other, an annular array of locking posts, typically on the cleat, includes a radially-facing lead-in ramp and recess. The teeth, during stem rotation, ride over a lead-in ramp before snapping into a recess on the locking post. A stop member on the post resists inadvertent relative rotation between the stem and receptacle connector and loosening of the installed cleat. The locking mechanism allows the cleat to be unscrewed for removal and replacement upon exertion of a predetermined level of torque (i.e., typically by means of a special cleat wrench), resulting in the resilient yielding of the locking posts. Both the teeth and posts are typically axially-extending members surrounding the threaded stem and socket.

There are several removable cleats being commercialized that utilize both the FAST TWIST® attachment mechanism and dynamic traction elements. Typically, these cleats utilize a base made from a first relatively hard polymer which includes a body member having thread form and a circular array of locking posts angularly spaced and uniformly arranged around a circular hub. A second softer and more resilient polymer material provides the dynamic or static traction elements or legs that extend downwardly and outwardly from the circular hub. The dynamic traction legs provide traction by 1) tangling with grass; 2) deflecting upwardly toward the outsole of the shoe and trapping grass between the upper surface of the traction leg and the sole of the shoe; and 3) when the shoe slips sideways, absorbing or opposing the force of the lateral slip and folding inwardly on themselves toward the cleat axis, whereby their downward or vertical extension of the elements resiliently increases from the extension in the unflexed position.

Conventionally, the requirement that the dynamic traction elements extend from the periphery of the circular hub serves to restrict the downward or vertical extension that the traction element can achieve when providing traction against lateral slip. In U.S. Patent application Publication No. 2008/0072460, published Mar. 27, 2008 there is disclosed a technique involving molding the softer and flexible body having the dynamic legs or elements separately from the harder and rigid hub, which includes static (i.e., non-flexing) traction elements or legs, and then securing the hub and body by a molded connecting piece (i.e., by other than molding the hub and legs as an integral unit). This method, in theory, allows the dynamic elements to be attached closer to the central longitudinal axis of the cleat (rather than at the hub periphery), thereby moving the dynamic element flexure point during lateral slip from the hub periphery to a location closer to the hub central axis. As a result, for the same overall height or vertical dimension of a cleat, the dynamic traction elements can be made longer from their proximal ends (i.e., the points of attachment to the hub) to their distal tips. The longer the lengths of the dynamic traction elements, the greater is their ability to flex as they bend inward toward the axis and extend outwardly to provide increased traction during lateral slip. However, the method of separately molding the dynamic elements unit and then attaching that unit to the hub by means of a separate connector is costly and results in the possibility of the traction element unit body becoming detached from the hub body.

Another limitation in the design of prior dynamic traction cleats is the need to provide a substantially solid or continuous circular hub in order to accommodate the above described FAST TWIST® locking mechanism. More specifically, the FAST TWIST® locking posts disposed on the cleat hub near its peripheral edge are equi-angularly spaced at very short angular distances about the threaded stem in order to work in concert with the locking teeth on the shoe-mounted receptacle. This leaves little leeway for varying the hub from the conventional continuous circular configuration; that is, the hub material must be continuous in order to provide support the entire array of locking posts on its top surface near the hub peripheral edge.

OBJECTS AND SUMMARY OF THE INVENTION

It is an object of the present invention to provide a cleat structure, and a shoe and cleat combination, in which dynamic traction elements on the cleat can be extended from inboard of the cleat hub periphery in an integrally molded cleat unit so as to preclude the possibility of the cleat components becoming dissociated.

It is another object of the invention to provide a cleat configuration with a modified hub structure requiring less material than the typical circular hub and that permits enhanced flexure of dynamic traction elements and improved locking of the cleat in a shoe-mounted receptacle.

Another object of the invention is to provide an improved dynamic traction element structure to optimize traction in a cleat.

It is a further object of the invention to provide a cleat structure, and a shoe and cleat combination, in which an improved locking post structure on the cleat provides for simpler and more efficient connection of the cleat to a shoe mounted receptacle and more effective locking of the cleat in that receptacle.

A still further object of the invention is to provide a method of manufacturing an improved integrally molded cleat having dynamic traction elements and locking posts.

Another object of the invention is to provide a removable traction cleat having a hub portion and a dynamic traction portion, the hub portion having at least one cut-out area defined through the entire hub thickness, the dynamic traction portion having at least one resiliently flexible dynamic traction element disposed below the hub and positioned in underlying alignment with and below the cut out area of the hub so as to be resiliently forced into the cut-out area under the weight load of a person wearing said shoe and stepping down on the cleat.

Still another object of the invention is to provide a removable traction cleat for a shoe having a hub and a dynamic traction portion with a plurality of dynamic traction elements disposed in angularly spaced relation below the hub, each dynamic traction element having a proximal end secured to the cleat radially inward from the hub outermost peripheral edge and extending downward and radially outward from its proximal end, the cleat being a one-piece unitary structure comprised of a first polymer for the hub being relatively hard and relatively inflexible, and a second polymer for the dynamic traction portion being softer and resiliently flexible, the hub and said dynamic traction portion being secured together by co-molding.

Yet another object of the invention is to provide a removable traction cleat for a shoe having a hub having a connecting structure and a locking structure on its top side and a ground engaging traction portion on its bottom side, the hub being configured as a plurality of radial spoke-like arms angularly spaced from one another by cut-out areas defined through the entire hub thickness and extending radially inward from the hub outermost peripheral edge, wherein the locking structure includes a plurality of locking posts extending parallel to the cleat axis from the top side of the hub, the locking posts being located on respective spoke-like arms and angularly spaced by the cut-out areas.

A further object of the invention is to provide a removable traction cleat for a shoe having a hub with a top side having connecting and locking structures for removably attaching the cleat along the cleat longitudinal axis to a receptacle mounted in the shoe, a traction portion on the bottom side of the hub for engaging the ground, the locking structure including a plurality of angularly spaced locking posts extending parallel to the cleat axis from the top side of the hub, each locking post including a radially inward facing surface having a recess defined therein and first and second angularly extending interference sections on opposite sides of said recess, the first and second interference sections being substantially symmetrical about the recess and extending toward and terminating a predetermined distance from the cleat axis.

In accordance with the present invention, a hub is provided with cut-out areas at its periphery aligned with respective dynamic traction elements that have their proximal end secured below the hub inboard of the hub periphery. The cut-out areas provide the hub with a generally cross-shaped configuration and permit the dynamic elements to be pushed up through the cut outs when flexed under load. The top surface of the dynamic traction element may be configured flat, much like a hammer head, to provide a plateau-like surface to more effectively trap grass blades between that surface and the shoe outsole.

The locking posts for locking the cleat with a FAST TWIST type of receptacle are disposed on the top surface of the hub on spoke-like arms between the cut out areas. Each locking post includes a radially inward-facing recess disposed between a pair of surfaces extending into interfering relation with teeth disposed on the receptacle. As the cleat and receptacle are being threadedly engaged, the post is sufficiently resiliently flexible to permit the teeth to ride over an interfering surface and snap into the recess to lock the cleat against subsequent inadvertent rotational movement relative to the receptacle. The two interfering surfaces for each post located on opposite sides of the recess provide greater locking force than the single shaped ramp used in prior art locking posts. Accordingly, fewer locking posts are required to effect positive locking, and the absence of hub material to support additional posts has no deleterious effect on the locking.

In order to permit the dynamic traction elements to resiliently flex independently of the hub from a location inboard of the hub periphery while being part of an integral one-piece cleat structure with the hub, a co-injection molding process is utilized. The term "co-molding" or "co-molded" as used herein refers to creating a one-piece or unitary structure through molding of at least two different polymers together, creating chemical bonds (and, if desired, additional mechanical bonds) between the parts in the same mold or die, and expressly includes, but is not to be limited to, such processes as two-shot molding, co-injection molding and insert molding. Two-shot molding is the preferred method of the present invention and, as is well known to those skilled in the art, involves the injection of two different polymers through two nozzles into one mold which can rotate to allow both materials to fill different areas of the same mold. In this case the harder hub polymer is injected first (i.e., the first shot) and the softer dynamic element body polymer is injected as the second shot. Because the two-shot injection molding process is fast and highly repeatable, the shrinkage of the first shot is very consistent and two different materials can be molded together with virtually no flash. The two polymers are joined by both chemical and mechanical bonds during the molding process. The resulting one-piece cleat is integral and devoid of the problem of the components coming apart as described above in connection with the prior art three-piece cleat.

These and other objects of the present invention are not mutually dependent and should be considered as individual objects as well as objects in combination.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

The following detailed description of FIGS. 1-12 and of the preferred embodiments reveal the methods and apparatus of the present invention. It is to be understood that the relative directional terms "top", "bottom", "upward", downward", "vertical" and horizontal", and the like, as used herein, refer to the orientation in a shoe outsole in which the cleat of the invention is installed when the shoe outsole rests on or is forced against a horizontal surface such as the ground, and these terms are not limiting on the orientation of the cleat or the scope of the invention. For purposes of understanding, the following directional terms as used herein shall have the following meanings: "angular" means the rotational direction about the central longitudinal axis A-A of the cleat about which the cleat is rotated during installation in a receptacle in the shoe outsole; "radial" refers to the direction perpendicular to axis A-A; and "axial" refers to the direction along or parallel to axis A-A. In addition, to provide a dimensional frame of reference to facilitate understanding of the invention, the following description includes dimensions for some of the structural features. It is to be understood that these dimensions are for reference and understanding and are not intended as limiting the scope of the invention.

Figure 1:
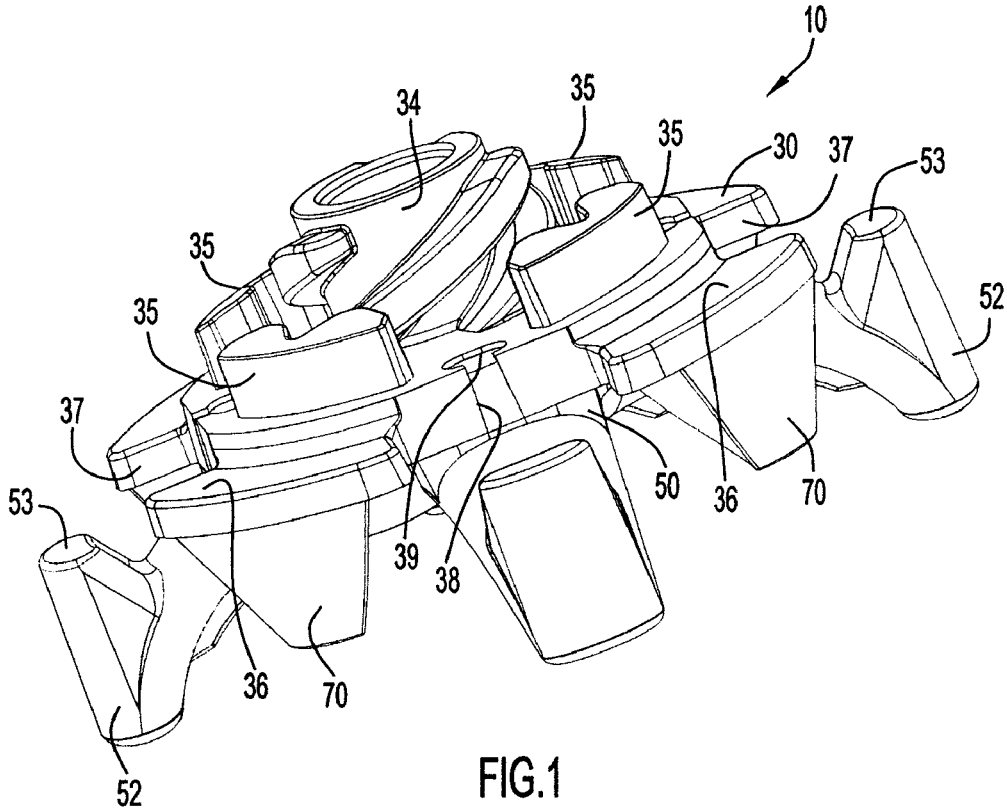
FIG. 1 is a top view in perspective of a preferred embodiment of a traction cleat of the present invention.
Figure 2:
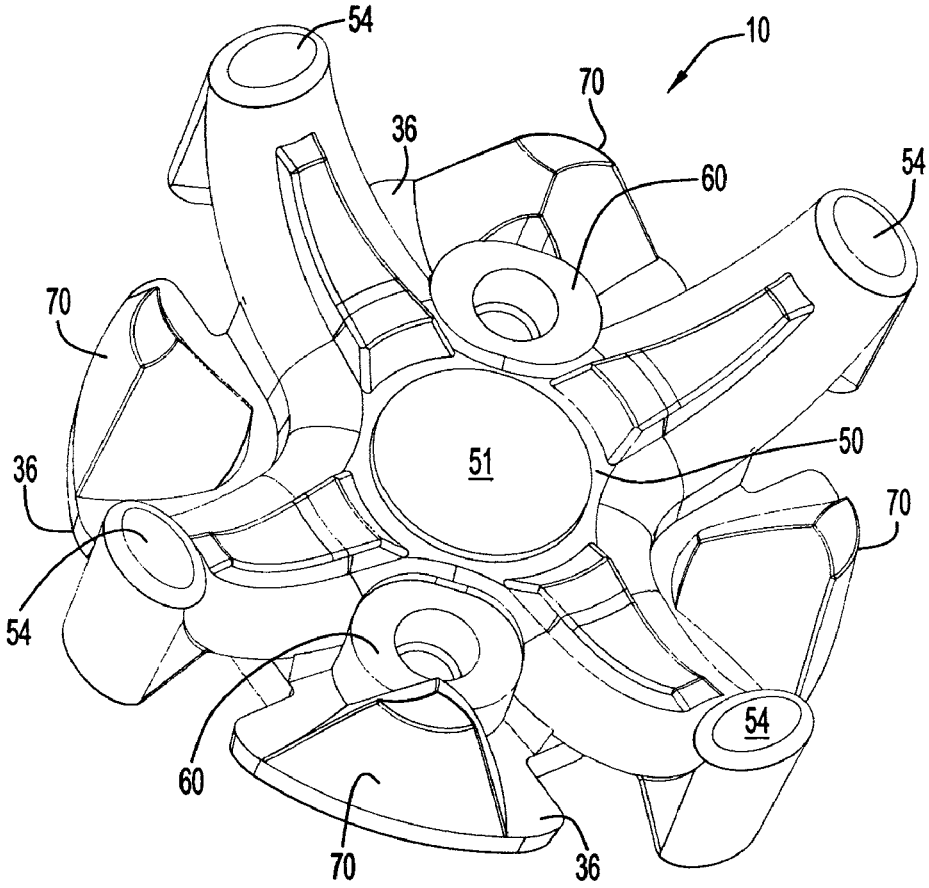
FIG. 2 is a bottom view in perspective of the traction cleat of FIG. 1.
Figure 3:
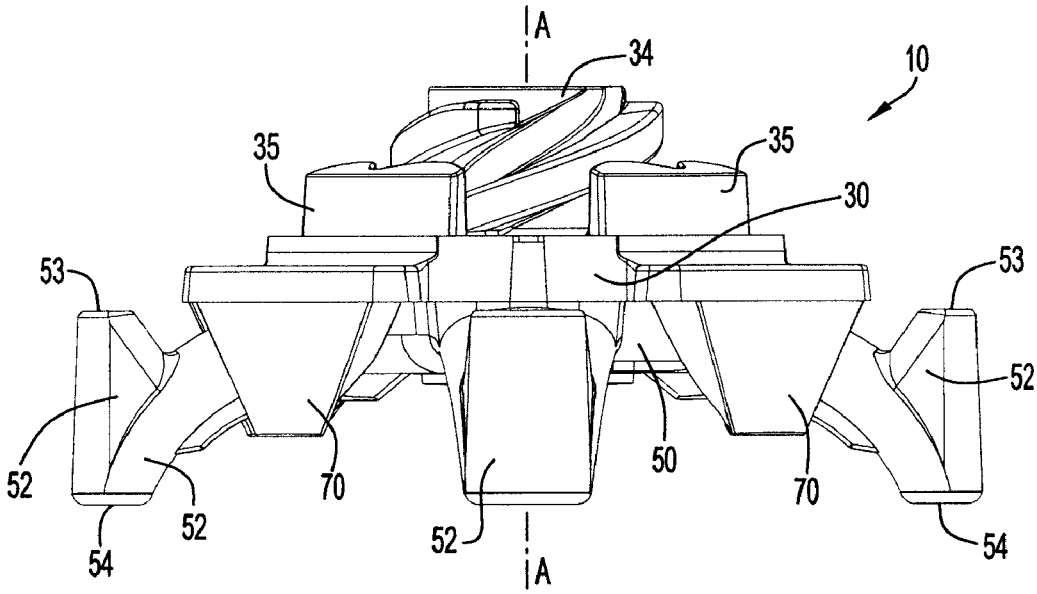
FIG. 3 is a side view in elevation of the traction cleat of FIG. 1.
Figure 4:
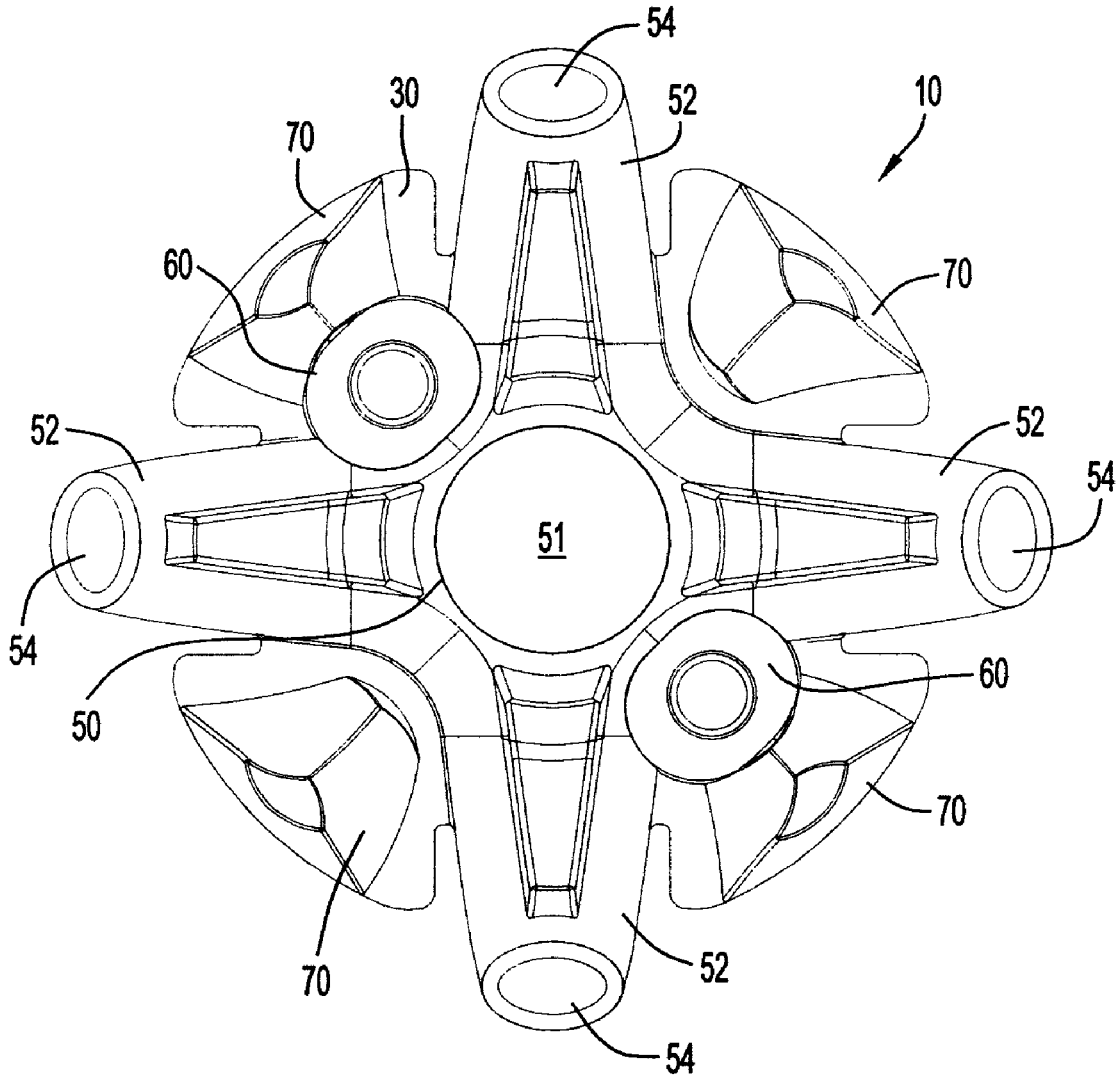
FIG. 4 is a bottom view in plan of the traction cleat of FIG. 1.
Figure 5:
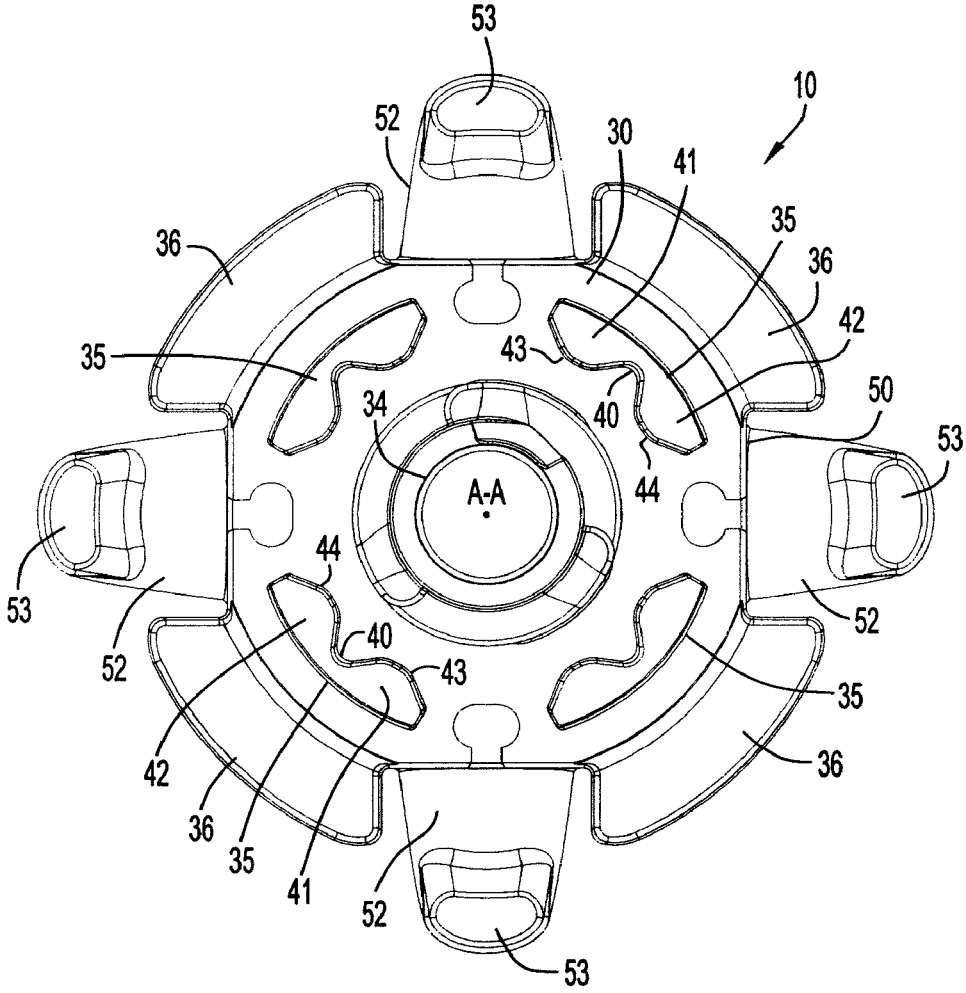
FIG. 5 is a top view in plan of the traction cleat of FIG. 1.
Figure 6:
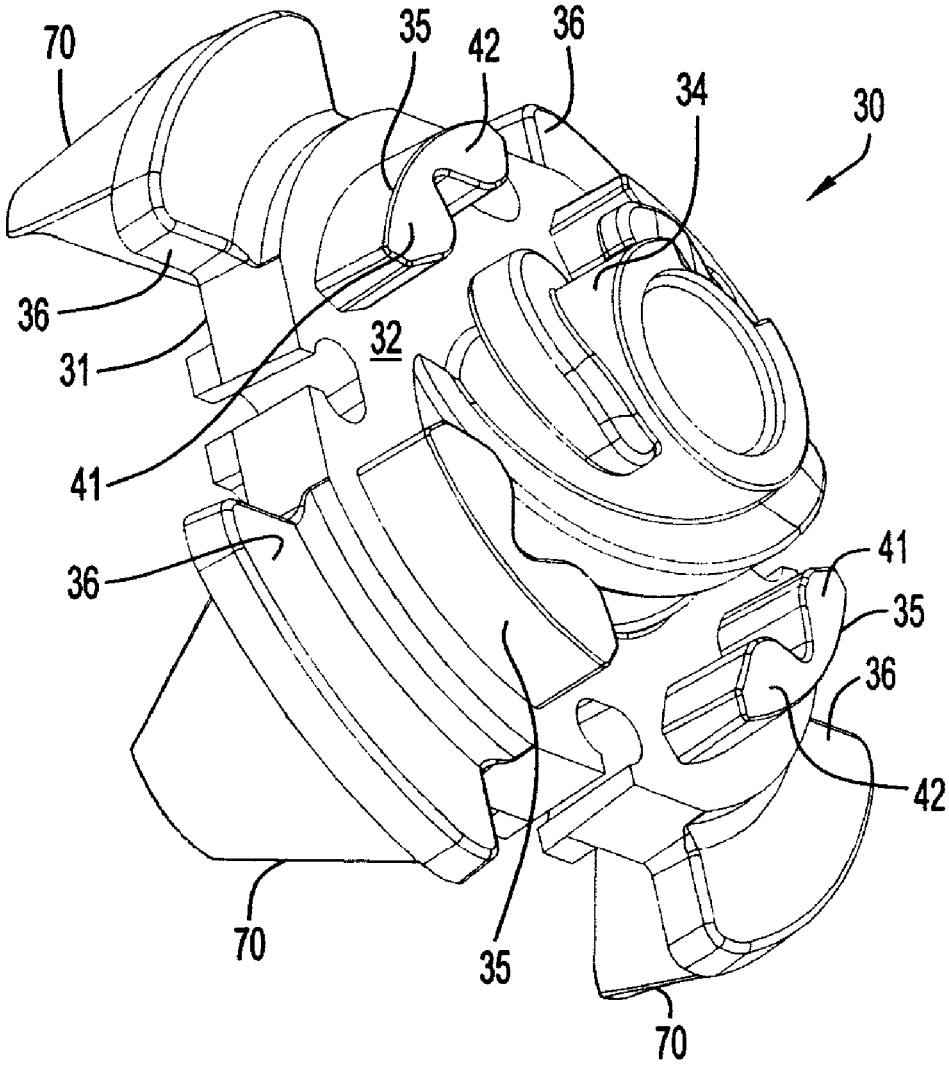
FIG. 6 is a top perspective view in perspective of the hub portion of the traction cleat of FIG. 1.
Figure 7:
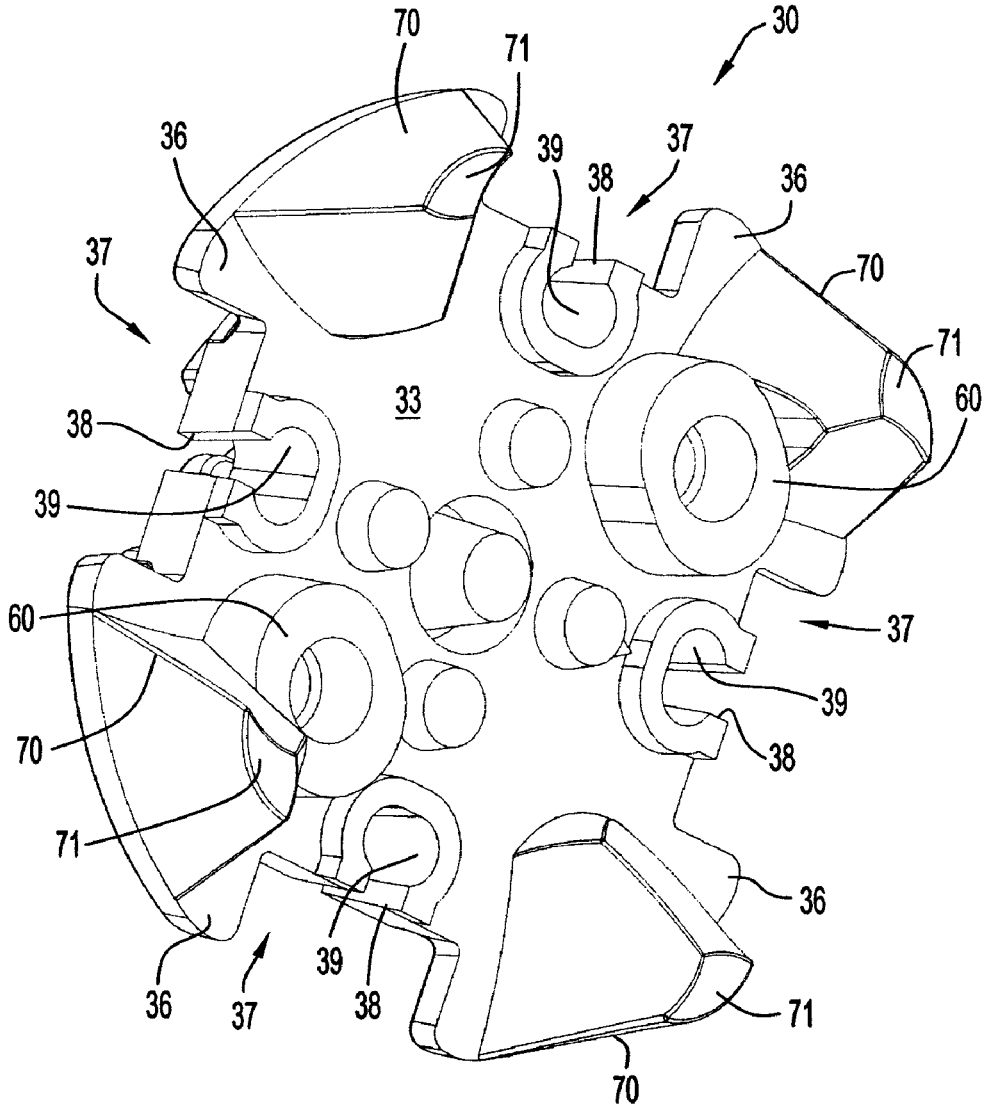
FIG. 7 is a bottom view in perspective of the hub portion of FIG. 6.
Figure 8:
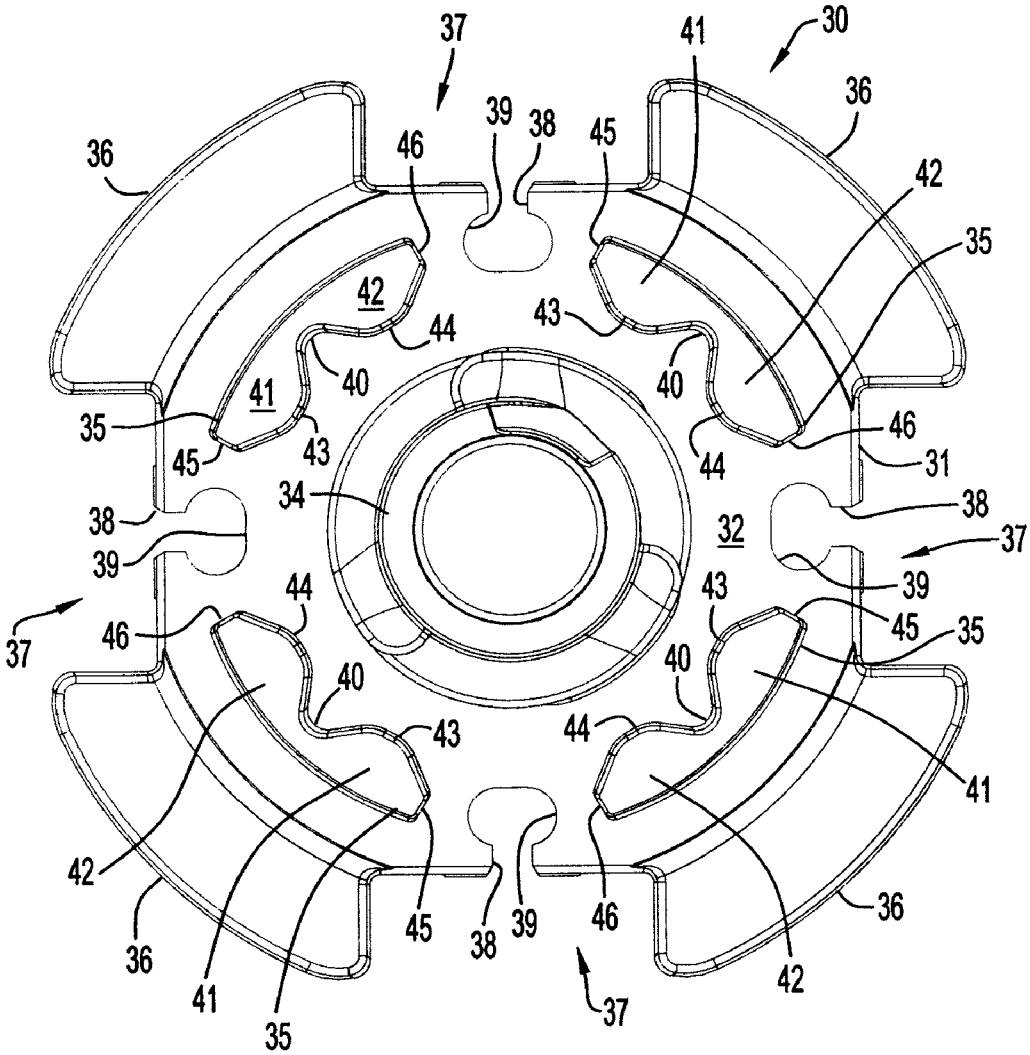
FIG. 8 is a top view on plan of the hub portion.
Figure 9:
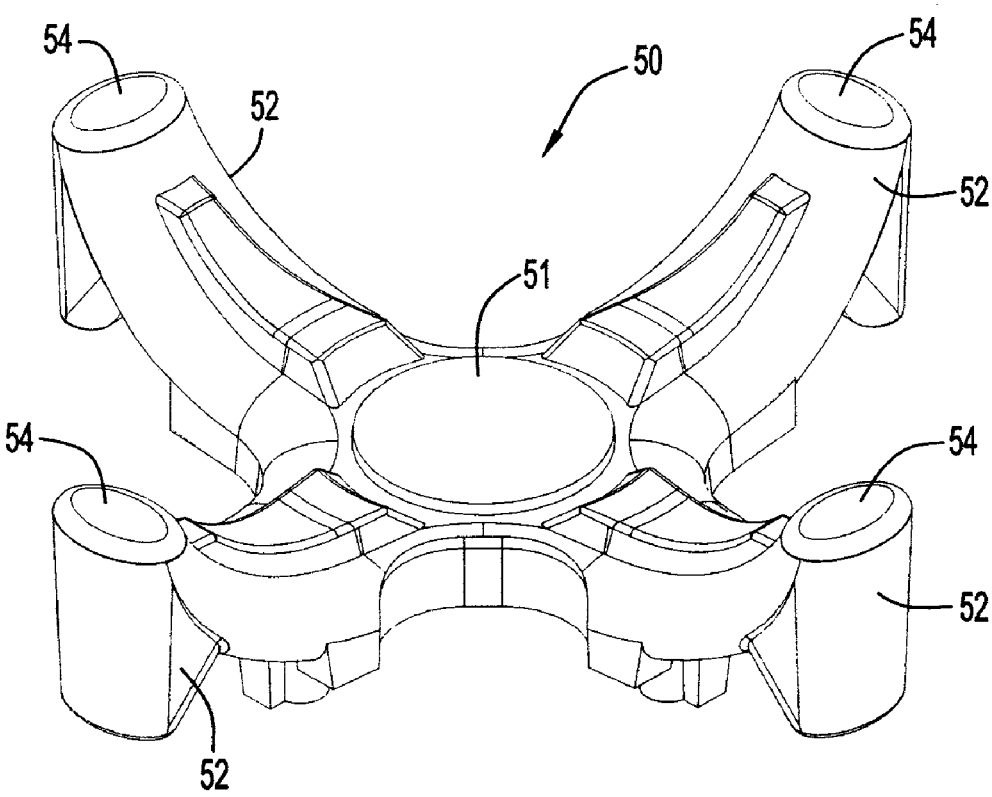
FIG. 9 is a bottom view in perspective of the dynamic traction portion of the traction cleat of FIG. 1.
Figure 10:
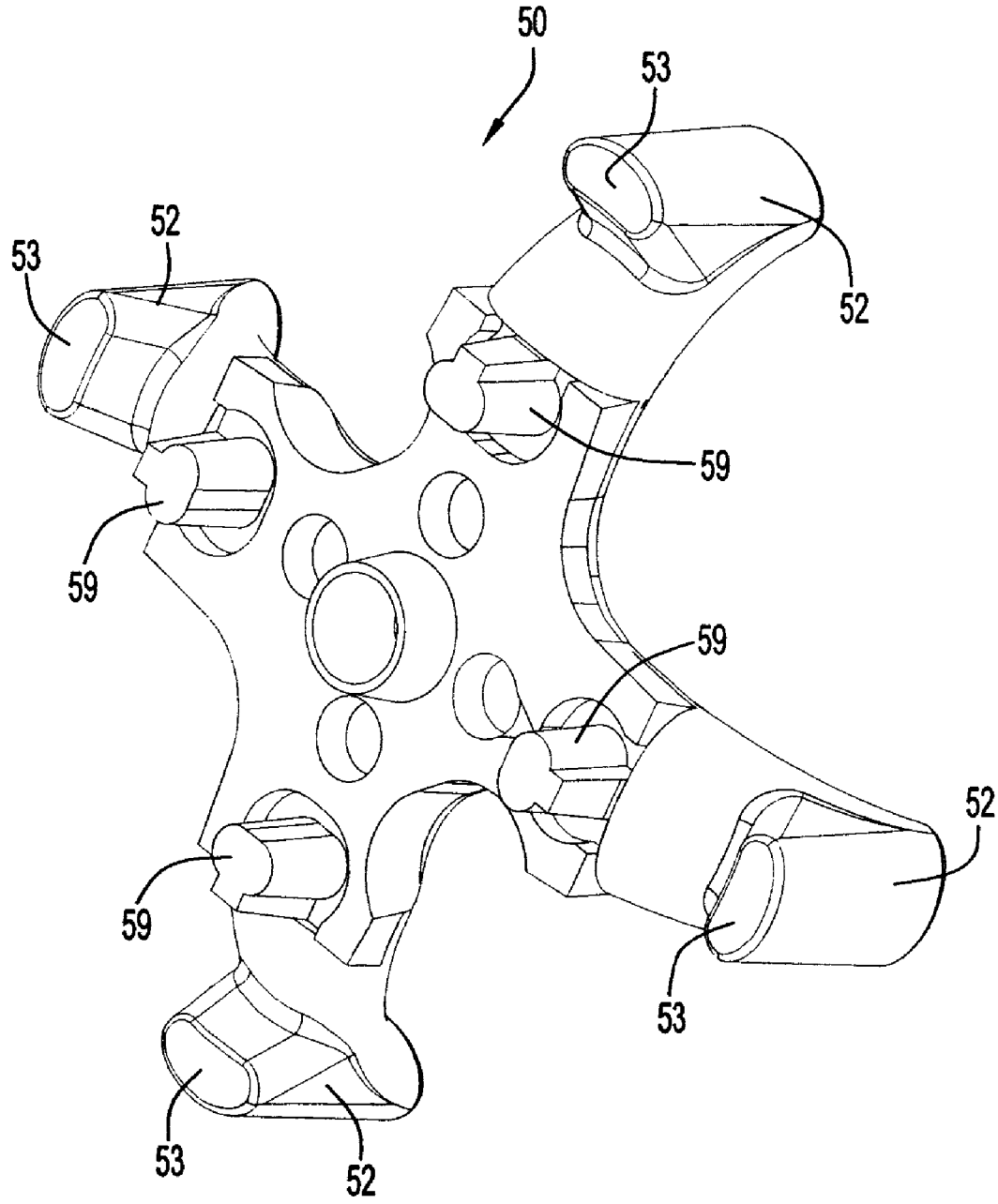
FIG. 10 is a top perspective view of the dynamic traction portion of FIG. 8.

A cleat 10 comprises two components, a hub portion 30 and a dynamic traction portion 50 co-molded as a one-piece integral unit. In order to more clearly illustrate the cleat and its components, the integral cleat 10 is shown in FIGS. 1-5, the hub portion alone is illustrated in FIGS. 6-8, and the dynamic traction portion is shown in FIGS. 9 and 10. Although the hub and dynamic traction portions are illustrated separately for purposes of clarity of this description, it is to be understood that these portions do not exist individually apart from the integrally molded cleat 10.

In the preferred embodiment, the co-molding process by which cleat 10 is formed is a two-shot molding process. Two-shot molding, per se, has been known and commercially utilized for several years. Hub portion 30 is formed from a first shot of relatively hard and inflexible polymer material, typically polyurethane with a hardness or Durometer in the range of 67 D to 75 D. Atop and chemically bonded with the hub portion is molded a second shot comprising the dynamic traction portion 50 from a relatively flexible polymer material, typically polyurethane with a Durometer in the range of 82 A to 90 A. Although forms of polyurethane are used for the two shots in the preferred embodiment, it is to be understood that other polymers, in some cases two different polymers, may be utilized. Hub portion 30 includes the cleat hub 31 having top and bottom surfaces 32 and 33, respectively. A threaded stem connector 34 projects upwardly from top surface 32 along the central longitudinal axis A-A of the cleat 10 about which stem 34 is rotated to threadedly engage a socket 101 in a receptacle 100 mounted in a shoe outsole as described in more detail below in reference to FIGS. 11 and 12. Cleat axis A-A, referred to herein for dimensional references, is the coaxial longitudinal centerline of stem 34. Also projecting upwardly from top side 32 are four substantially identical locking posts 35 arranged in equi-angularly spaced relation symmetrically about the stem 34 and the longitudinal axis of the cleat and hub. The resilient locking posts extend axially from the top surface of the hub and surround stem 34, forming a ring concentric with the stem. The axial extent of each post pair is roughly half the axial height of stem, and each post is slightly resiliently pivotable radially outward about its root connection to the top side 32 of the hub.

Hub 31 is in the general shape of a cross having four spoke-like legs 36 equi-angularly spaced symmetrically about axis A-A. Legs 36 are separated angularly by four respective radially extending cut-outs 37 defined through the hub thickness between the top and bottom sides and extending radially inward from the outermost peripheral edge of the hub at the distal ends of legs 36. Each cut-out 37 is substantially rectangular with an open outwardly facing side. The rectangular shape is convenient for the preferred embodiment but is not limiting on the scope of the invention; that is, the cut-out can be rounded, polygonal, etc. To provide an exemplary frame of dimensional reference without limitation on the scope of the invention, in the preferred embodiment the diameter of hub 31 is approximately 23.5 mm, the long side (i.e., the exterior and interior sides) of rectangular cut-out 37) is approximately 7.0 mm, and the short side or depth of the cut-out is approximately 3.25 mm. The base or interior side of each cut-out 37 has a small centrally located opening 38 defined therein leading to a generally elliptical channel 39. Opening 38 and channel 39 form a bonding keyway for mechanically bonding the hub portion 30 to the dynamic traction portion 50 during the molding process. The mechanical bond is in addition to the chemical bonding between the parts occurring during the molding process and further assures the integrity of the molded one-piece unit.

Each locking post 35 is, in essence, a double locking post as compared to the locking posts disclosed in the Kelly patents. Each locking post 35 is located on a respective spoke-like leg 36 on the top side 32 of hub 31. Locking post 35 includes a smoothly arcuate outwardly facing surface having an angular length about the cleat longitudinal axis of approximately 30°. The outer surfaces of all four locking posts are segments of a common circle centered on the cleat longitudinal axis. The top surface of each post is angled slightly upward toward the stem so that the radially inward facing surface of each post 35 has the greatest axial height above the hub. The radially inward facing surface of each locking post has mirror image (or angular) symmetry about a radial line drawn from the cleat longitudinal axis to the locking post center point and includes a centrally located recess 40 defined therein between first and first and second interference sections 41, 42, respectively, which are virtual images of one another. The vertex of recess 40 is arcuate with a small radius of curvature on the order of 0.5 mm. The sides of the recess are substantially straight lines and converge toward the recess center at an angle of approximately 74° and form one side of a respective interference section 41, 42. Those sides extend to respective peaks 43, 44 which constitute the radially interior-most points on the interference sections. Angularly outward from these peaks the interior surface of each interference section slopes outwardly away from the peaks and terminates at a respective post sidewall 45, 46. These sidewalls are relative short straight linear segments on the order of 1.3 mm. Importantly, the peaks 43, 44 are positioned to contact locking teeth in the receptacle, in the manner described hereinbelow, as part of the locking feature on the cleat and receptacle engagement. In the preferred embodiment the peaks 43, 44 are disposed approximately 5.87 mm from the cleat longitudinal axis.

Four substantially identical static traction elements 70 depend from the bottom side 33 of hub 31 at equi-angularly spaced locations proximate the hub outermost peripheral edge. Specifically, each static traction element 70 depends from the distal end of a respective spoke-like leg 36. Elements 70 are referred to as "static" because, being part of the relatively hard and rigid hub structure, elements 70 are likewise substantially rigid and inflexible as compared to the dynamic traction elements described in detail below. Each static traction element 70 is generally prismatic in configuration with three side surfaces tapering downwardly and terminating at a respective corner of a generally triangular flat bottom surface 71. One of the side surfaces of each static element faces radially outward and is substantially perpendicular to the bottom side 33 of hub portion 31. The bottom side 33 of the hub, as best illustrated in FIG. 7, also includes a plurality of downward projections and a recess for enhancing the chemical and mechanical bonding of hub portion 30 to the dynamic traction portion 50 during the two-shot molding process.

Stem 34 is exteriorly threaded to engage interior threading in a receptacle socket. In the preferred embodiment a three-start thread is provided to minimize the angle through which the stem must be rotated to effect full insertion into the receptacle socket.

Dynamic traction portion 50 includes a central body portion 51 from the peripheral edge of which four equi-angularly spaced dynamic traction elements 52 extend in an arc radially outward and downward. In the preferred embodiment central body portion 51 is circular and concentrically positioned about the cleat axis A-A. Body portion 51 resides below the bottom side 33 of hub portion 30, whereby the proximal ends of dynamic traction element similarly reside below the hub. Thus, where most prior art dynamic traction elements have their proximal ends secured at or near the hub periphery, elements 52 are secured to the cleat well inboard from the hub periphery and flex upwardly under load from that inboard attachment point. The result is that, for the same radial extension beyond the hub periphery, dynamic traction element 52 has a greater freedom to flex under load. In order to provide a dimensional frame of reference, in the preferred embodiment, central body portion has a diameter of approximately 7 mm and the elements 52 extend radially therefrom; the radial length of each element 52 is approximately 10.85 mm; and the thickness of each element 52 tapers from approximately 6.5 mm at its root or proximal end to approximately 4.2 mm at its distal end. The outer surface of static elements 70 are approximately 11.7 mm from axis A-A. As can be seen in the drawings, dynamic elements 52, when unflexed, extend radially outward beyond the hub and the static elements 70, and are narrower than cut-outs 37 so as to easily flex upwardly under load without interference from the hub. Dynamic elements 52, when unflexed, are spaced from the bottom side of the hub throughout the entire lengths so as to permit flexure about their proximal ends at a location well inboard of the hub peripheral edge.

Each dynamic traction element 52 is arcuate in its downward and outward extension. The upper surface of the element, at its distal end, may be provided with a raised flat plateau surface 53 to more efficiently trap grass blades between that surface and sole of the shoe to thereby increase one aspect of traction as the element flexes upward. The plateau extension may be viewed as a piggyback static traction element. Thus, in the unflexed state of the dynamic traction element, the piggyback static element extends upwardly and has a substantially flat distal end adapted to trap grass blades against a shoe sole when the dynamic element is flexed upwardly. The outward facing surface of the piggyback static element is normally substantially vertical so that it interferingly interacts with grass and turf in response to lateral slip of the shoe. The interfering force causes the dynamic element to bend and resiliently flex inward toward the hub axis, thereby exposing more of the outward facing surface of the dynamic element to be exposed to the grass and turf through the radial slots or openings in the hub. The result is an increased exposure of the overall lateral slip traction surface to further resist slippage.

The bottom surface 54 of the distal end of element 52, in this case shown with an elliptical shape, may also be flat as opposed to being edge-like to better distribute the force applied to the surface of a golf green. The distributed force minimizes the possibility of puncturing the turf on a golf green while providing a surface that frictionally engages the turf to provide enhanced traction as element 52 flexes and surface 54 moves along the surface.

One of the features of the present invention is the angular alignment of each dynamic traction element with a respective cut-out 37. The aligned cut-out permits dynamic traction element 52 to resiliently flex upwardly under load without being impeded by the outermost portion of hub 31. Moreover, as noted above, each dynamic element emanates from the central section 51 of the dynamic traction portion, well inboard of the hub periphery, providing greater room for dynamic element flexure, even in the case of lateral movement of the cleats during which grass and turf impinge on the outwardly facing surface of the element, tending to have it flex inwardly back onto itself. In this regard, each dynamic element has a smoothly curving inward facing surface that facilitates this inward bending flexure.

It should also be noted that the downward extension below the hub of the distal end of dynamic traction elements 52 when not under load (i.e., when unflexed) is greater than the downward extension of the distal end of static traction elements 70. As a result, when the wearer of the shoe steps down, the dynamic elements 52 make first contact with the ground. The dynamic elements flex up through the hub in cut-outs 37 until the static elements contact the ground and begin to bear the weight load. As best illustrated in FIG. 10, the top side of dynamic traction portion 50 includes bonding keys 59 extending upwardly and formed during the molding process to fill respective bonding keyways 38, 39 with polymer from the second shot of polymer material from the dynamic traction portion 50. The top side of dynamic traction portion 50 also includes upwardly extending projections and downward recesses to cooperate with the correspondingly positioned recesses and projections in the bottom side of hub portion 30 further enhance chemical and mechanical bonding between these portions during the molding process.

Figure 11:
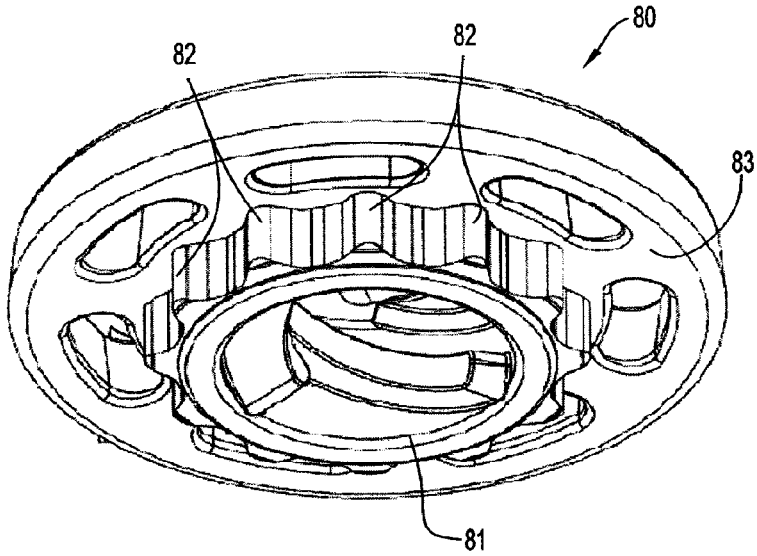
FIG.11 (PRIOR ART)
FIG. 11 is a bottom view in perspective of a receptacle for receiving and engaging the traction element of FIG. 1.
Figure 12:
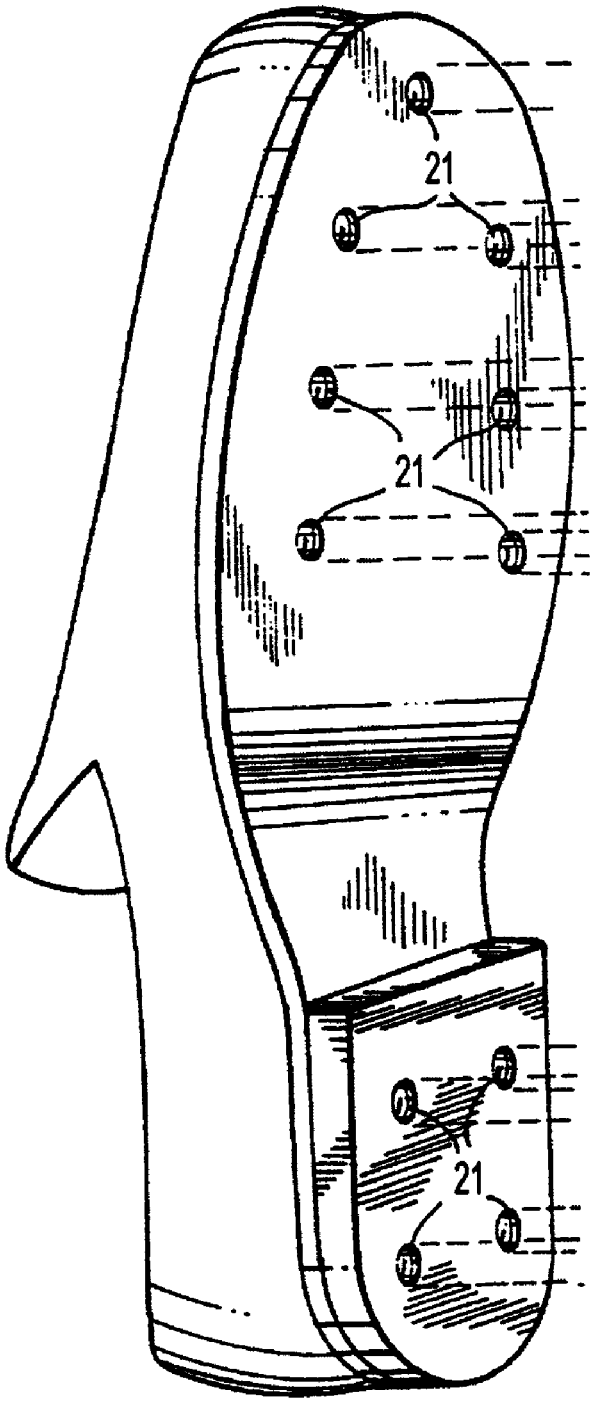
FIG. 12 is a partially diagrammatic view in perspective of an athletic shoe in which the traction cleat of the present invention is utilized.

There is illustrated in FIG. 11 a prior art receptacle with which cleat 10 connects and locks in an improved manner. Specifically, receptacle 80 includes an internally threaded connector 81 adapted to receive and threadedly engage threaded stem 34 of cleat 10. Connector 81 is a hollow cylinder projecting downwardly from a flat base member that is typically embedded in the outsole of a shoe of the type illustrated in FIG. 12. The hollow cylinder carries the engagement thread on its interior surface for connection to the cleat as described. On the outer wall of the cylinder there is a continuous array of locking teeth 82, each tooth having a generally triangular configuration with an apex pointing radially outward from the central longitudinal axis of the receptacle which, when the cleat and receptacle are engaged, is coaxial with the central longitudinal axis of the cleat. The radial extension of the apex of each tooth 82 is beyond distance of the peaks 43, 44 of the locking posts 35 of cleat 10. Accordingly, as the cleat stem 34 is rotated in connector 81 during insertion of cleat to in the receptacle 80, teeth 82 interfere with the locking posts. The locking posts are slightly resilient and initially flex radially outward about their proximal root ends during the initial part of the engagement process. Specifically, during this initial part of the engagement process, with only a portion of stem 34 entered in connector 81, only the longitudinal upper part of locking posts 35 interfere with the lower part of the locking teeth 82. The rotational force applied to the cleat, typically with a conventional cleat wrench engaging the tool access holes 60 formed in the bottom side 33 of hub portion 30, is sufficient at this point of the engagement process to cause the locking post to pivotally flex radially outward about its root or base, thereby permitting continued rotation of stem 34 in connector 81. When the stem is maximally engaged with connector 81, greater lengths of the locking teeth and locking posts are engaged, particularly at or close to the base of the locking posts where there is greater resistance to flexure. As a result, upon full threaded engagement, the interference between the locking posts and locking teeth prevent inadvertent mutual rotation between the cleat and the receptacle, thereby effectively locking the two together. To remove the cleat from the receptacle the rotational force exerted via the cleat wrench is sufficient to flex the locking posts and unlock the engagement between the cleat and receptacle.

Having described preferred embodiments of new and improved traction cleat with extended dynamic traction elements and athletic shoes employing same, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A removable traction cleat for a shoe comprising:

a hub having an axis and an outermost peripheral edge radially spaced from said axis, said hub including a top surface having connecting structure for removably attaching the cleat along said axis to a receptacle mounted in the shoe, and a bottom surface opposite said top surface;

a dynamic traction portion for engaging the ground;

wherein said hub has at least one cut-out area defined through the entire hub thickness between said top and bottom surfaces and extending radially inward from the hub outermost peripheral edge toward said axis;

wherein said dynamic traction portion includes at least one flexible dynamic traction element when unflexed disposed in its entirety below and spaced from the bottom surface of the hub throughout the entire length of the dynamic traction element, said dynamic traction element having a proximal end secured to said cleat radially inward from the hub outermost peripheral edge and extending below said bottom surface downward and radially outward from said proximal end and said axis and terminating at a distal end, said dynamic traction element being angularly positioned in underlying alignment with and below said cut out area of said hub, said dynamic traction element being sufficiently resiliently flexible to be forced into said cut-out area of said hub in response to being forced upwardly under the weight load of a person wearing said shoe and stepping down on the cleat.

2. The cleat according to claim 1 wherein said cleat is a one-piece unitary structure comprised of first and second different polymers, said first polymer comprising said hub and being relatively hard and relatively inflexible, said second polymer comprising said dynamic traction portion and being softer and resiliently flexible.

3. The cleat according to claim 2 wherein said hub and said dynamic traction portion are secured together by co-molding.

4. The cleat according to claim 1 wherein said dynamic traction element includes at its distal end a raised substantially flat plateau-like top surface extension sized and configured to fit in and pass through said cut-out area when said dynamic traction element is flexed upwardly.

5. The cleat according to claim 1 wherein said hub has a plurality of said cut-out areas defined through the entire hub thickness between said top and bottom surfaces and extending radially inward from the hub outermost peripheral edge toward said axis, said cut-out areas being angularly spaced about said axis;

wherein said dynamic traction portion includes a plurality of said flexible dynamic traction elements spaced radially inward from said outermost peripheral edge and disposed when unflexed in angularly spaced relation below and spaced from the bottom surface of the hub throughout the entire lengths of the dynamic traction elements, each dynamic traction element having a proximal end secured to said cleat radially inward from the hub outermost peripheral edge and extending below said bottom surface of said hub downward and radially outward from its proximal end and said axis and terminating at a distal end, each dynamic traction element being angularly positioned in underlying alignment with and below a respective cut-out area of said hub and being sufficiently resiliently flexible to be forced into said cut-out area of said hub in response to being forced upwardly under the weight load of a person wearing said shoe and stepping down on the cleat.

6. The cleat according to claim 5 wherein said cleat is a one-piece unitary structure comprised of first and second different polymers, said first polymer comprising said hub and being relatively hard and relatively inflexible, said second polymer comprising said dynamic traction portion and being softer and resiliently flexible, wherein said hub and said dynamic traction portion are secured together by co-molding.

7. The cleat according to claim 6 wherein said hub includes a plurality of inflexible static traction elements disposed on its bottom surface proximate said outermost peripheral edge and projecting downward at angularly spaced locations.

8. The cleat according of claim 7 wherein said static traction elements and said dynamic traction elements are positioned alternately angularly about said axis.

9. The cleat according to claim 6 wherein said hub is configured as a plurality of radial spoke-like arms angularly spaced from one another by said cut-out areas.

10. The cleat according to claim 9 wherein said hub further comprises a locking structure for locking said cleat in the receptacle, said locking structure including a plurality of locking posts extending parallel to said axis from said top surface of said hub, each locking post being located on a respective spoke-like arm.

11. The cleat according to claim 10 wherein each locking post includes a radially inward facing surface having a recess defined therein, said surface having first and second angularly extending interference sections on opposite sides of said recess, said first and second interference sections extending toward and terminating a first predetermined distance from said axis.

12. The cleat according to claim 11 further comprising said receptacle having at least one locking tooth projecting radially outward from a hollow cylindrical connector that is adapted to receive a portion of said locking structure along said axis, wherein said tooth has a radially distal end terminating a second predetermined distance from said axis, said second predetermined distance being slightly greater than said first predetermined distance.

13. The cleat according to claim 11 further comprising said receptacle having a plurality of angularly spaced locking teeth projecting radially outward from a hollow cylindrical connector that is adapted to receive a portion of said locking structure along said axis, wherein each tooth has a radially distal end terminating a second predetermined distance from said axis, said second predetermined distance being slightly greater than said first predetermined distance.

14. The cleat according to claim 11 wherein said first and second angularly extending interference sections are substantially symmetrically configured and positioned relative to a radial line extending from said axis through said recess.

15. A removable traction cleat for a shoe comprising:

a hub having an axis and an outermost peripheral edge radially spaced from said axis, said hub including a top surface having connecting structure for removably attaching the cleat along said axis to a receptacle mounted in the shoe, and a bottom surface opposite said top surface;

a dynamic traction portion for engaging the ground;

wherein said dynamic traction portion includes a plurality of flexible dynamic traction elements disposed in angularly spaced relation below the bottom surface of said hub, each having a proximal end secured to said cleat radially inward from the hub outermost peripheral edge, each dynamic traction element extending below said bottom surface in spaced relation to said bottom surface throughout the entire length of the dynamic traction element downward and radially outward from its proximal end and said axis and terminating at a distal end;

wherein said cleat is a one-piece unitary structure comprised of first and second different polymers, said first polymer comprising said hub and being relatively hard and relatively inflexible, said second polymer comprising said dynamic traction portion and being softer and resiliently flexible relative to said first polymer, wherein said hub and said dynamic traction portion are secured together by co-molding.

16. The cleat according to claim 15 wherein said hub is configured as a plurality of radial spoke-like arms angularly spaced from one another by cut-out areas.

17. The cleat according to claim 16 wherein said hub further comprises a locking structure for locking said cleat in the receptacle, said locking structure including a plurality of locking posts extending parallel to said axis from said top surface of said hub, each locking post being located on a respective spoke-like arm.

18. The cleat according to claim 17 wherein each locking post includes a radially inward facing surface having a recess defined therein, said surface having first and second angularly extending interference sections on opposite sides of said recess, said first and second interference sections extending toward and terminating a first predetermined distance from said axis.

19. The cleat according to claim 18 further comprising said receptacle having at least one locking tooth projecting radially outward from a hollow cylindrical connector that is adapted to receive a portion of said connecting structure along said axis, wherein said tooth has a radially distal end terminating a second predetermined distance from said axis, said second predetermined distance being slightly greater than said first predetermined distance.

20. The cleat according to claim 15 wherein said hub includes a plurality of inflexible static traction elements disposed on its bottom surface proximate said outermost peripheral edge and projecting downward at angularly spaced locations.

21. The cleat according of claim 20 wherein said static traction elements and said dynamic traction elements are positioned alternately angularly about said axis.

22. A removable traction cleat for a shoe comprising:

a hub having an axis and an outermost peripheral edge radially spaced from said axis, said hub including a top surface having connecting structure for removably attaching the cleat along said axis to a receptacle mounted in the shoe, and a bottom surface opposite said top side surface;

a traction portion for engaging the ground including at least one traction element located and spaced radially inward from said outermost peripheral edge;

wherein said hub is configured as a plurality of radial spoke-like arms angularly spaced from one another by cut-out areas defined through the entire hub thickness between said top and bottom surfaces and extending radially inward from the hub outermost peripheral edge toward said axis; and wherein said hub further comprises a locking structure for locking said cleat in the receptacle, said locking structure including a plurality of locking posts extending parallel to said axis from said top surface of said hub, each locking post being located on a respective spoke-like arm and angularly spaced from adjacent locking posts across respective cut-out areas.

23. The cleat according to claim 22 wherein each locking post includes a radially inward facing surface having a recess defined therein, said radially inward facing surface having first and second angularly extending interference sections on opposite sides of said recess, said first and second interference sections extending toward and terminating a first predetermined distance from said axis.

24. The cleat according to claim 23 further comprising said receptacle having at least one locking tooth projecting radially outward from a hollow cylindrical connector that is adapted to receive a portion of said connecting structure along said axis, wherein said tooth has a radially distal end terminating a second predetermined distance from said axis, said second predetermined distance being slightly greater than said first predetermined distance.

25. The cleat according to claim 22 wherein said cleat is a one-piece unitary structure comprised of first and second different polymers, said first polymer comprising said hub and being relatively hard and relatively inflexible, said second polymer comprising said traction portion and being softer and resiliently more flexible.

26. The cleat according to claim 25 wherein said hub and said traction portion are secured together by co-molding.

27. A removable traction cleat for a shoe comprising:

a hub having an axis and an outermost peripheral edge radially spaced from said axis, said hub including a top surface having connecting structure for removably attaching the cleat along said axis to a receptacle mounted in the shoe, and a bottom surface opposite said top surface;

a traction portion for engaging the ground;

wherein said hub further includes locking structure comprising a plurality of angularly spaced locking posts extending parallel to said axis from said top surface of said hub, each locking post including a radially inward facing surface having a recess defined therein, said radially inward facing surface having first and second angularly extending interference sections on opposite sides of said recess, said first and second interference sections extending toward and terminating a first predetermined distance from said axis.

28. The cleat according to claim 27 further comprising said receptacle having at least one locking tooth projecting radially outward from a hollow cylindrical connector that is adapted to receive a portion of said connecting structure along said axis, wherein said tooth has a radially distal end terminating a second predetermined distance from said axis, said second predetermined distance being slightly greater than said first predetermined distance.

29. A traction cleat for a shoe comprising:

a hub having an axis and an outermost peripheral edge radially spaced from said axis, said hub including a top surface and a bottom surface opposite said top surface;

a dynamic traction portion for engaging the ground;

wherein said hub has a plurality of angularly spaced cut-out areas defined through the entire hub thickness between said top and bottom surfaces and extending radially inward from the hub outermost peripheral edge toward said axis;

wherein said dynamic traction portion includes a plurality of flexible dynamic traction elements disposed in their entireties when unflexed below and spaced from the bottom surface of the hub throughout the entire lengths of the dynamic traction elements, said dynamic traction elements each having a proximal end secured to said cleat radially inward from the hub outermost peripheral edge and extending downward and radially outward from said proximal end and said axis and terminating at a distal end, said dynamic traction elements being angularly positioned in underlying alignment with and below respective cut-out areas of said hub, said dynamic traction elements being sufficiently resiliently flexible to be forced into said cut-out areas of said hub in response to being forced upwardly under the weight load of a person wearing said shoe and stepping down on the cleat.

30. The cleat according to claim 29 wherein said cleat is a one-piece unitary structure comprised of first and second different polymers, said first polymer comprising said hub and being relatively hard and relatively inflexible, said second polymer comprising said dynamic traction portion and being softer and resiliently flexible, and wherein said hub and said dynamic traction portion are secured together by co-molding.

31. The cleat according to claim 29 wherein said hub includes a plurality of inflexible static traction elements disposed on its bottom surface proximate said outermost peripheral edge and projecting downward at angularly spaced locations.

* * * * *